United States Patent [19]

Phillips

[11] Patent Number: 4,463,358

[45] Date of Patent: Jul. 31, 1984

[54] CONVERTIBLE TERMINATION TIP FOR SUBMARINE BUOYANT CABLE ANTENNA SYSTEM

[75] Inventor: Raymond J. Phillips, Oakdale, Conn.

[73] Assignee: The United States of America as represented by the Secretary of the Navy, Washington, D.C.

[21] Appl. No.: 319,537

[22] Filed: Nov. 9, 1981

[51] Int. Cl.[3] ..... H01Q 1/34

[52] U.S. Cl. ..... 343/709; 343/719; 339/32 R; 174/74 R

[58] Field of Search ..... 343/709, 710, 719, 790; 174/705, 74 R, 75 C, 76, 78; 339/32 R, 33, 177 R, 177 E, 38, 116 R, 90 R, 255 R, 256 R

[56] References Cited

U.S. PATENT DOCUMENTS

| | | | |
|---|---|---|---|
| 2,780,792 | 2/1957 | Earl | 339/256 RT |
| 3,170,752 | 2/1965 | Van Horssen | 339/74 R |
| 3,371,308 | 2/1968 | Maston | 339/256 |
| 3,599,213 | 10/1969 | Fessenden | 343/710 |
| 3,683,322 | 8/1972 | Hults | 339/255 R |
| 3,816,641 | 6/1974 | Iversen | 174/76 |
| 3,818,420 | 6/1974 | Barr | 339/90 R |
| 3,976,352 | 8/1976 | Spinner | 339/177 R |
| 4,202,592 | 5/1980 | Rullier et al. | 339/116 R |
| 4,258,970 | 3/1981 | Bourdon et al. | 339/38 |
| 4,331,374 | 7/1980 | Phillips | 174/75 C |
| 4,377,320 | 11/1980 | Lathrop et al. | 339/177 R |

*Primary Examiner*—Eli Lieberman
*Assistant Examiner*—Michael C. Wimer
*Attorney, Agent, or Firm*—Robert F. Beers; Arthur A. McGill; Prithvi C. Lall

[57] ABSTRACT

A termination tip for submarine buoyant cable antenna systems can quickly be converted from grounding to insulating and vice versa any number of times. The nosepiece assembly fits over a pin contact of wire and is screwed onto a connector that holds the wire. An O-ring between the wire and the nosepiece assembly seals out seawater. The nosepiece assembly is either insulating or conducting depending on the desired configuration.

6 Claims, 3 Drawing Figures

CONVERTIBLE TERMINATION TIP FOR SUBMARINE BUOYANT CABLE ANTENNA SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to submarine buoyant cable antenna systems and more particularly to the termination tips of the cable.

(2) Description of the Prior Art

The prior art termination tips are of either the grounding or insulating variety. None are convertible. The MX 4217 tip is non-flexing, grounding only and has less tensile strength than the present invention. The MX 9050 tip, presently in wide use, has less tensile strength than the present invention and is grounding only. The MX 9246 tip, in present limited use, has less tensile strength than the present invention and is of only the insulating variety.

SUMMARY OF THE INVENTION

It is therefore a general object of the present invention to provide an improved termination tip for submarine buoyant cable antenna systems. In addition, it is an object that the termination tip is convertible from grounding to insulating and vice versa. It is also desirable to have good tensile strength and flexibility.

This is accomplished in accordance with the present invention by providing press fit nose sections that fit over the end of the cable and attach to a cable connector. An O-ring seals the seawater from the contact pin at the end of the cable. A transition from the metal components to the cable components is provided by a flexible sleeve.

DESCRIPTION OF THE PREFERRED EMBODIMENTS

Figures 1, 2, 3:
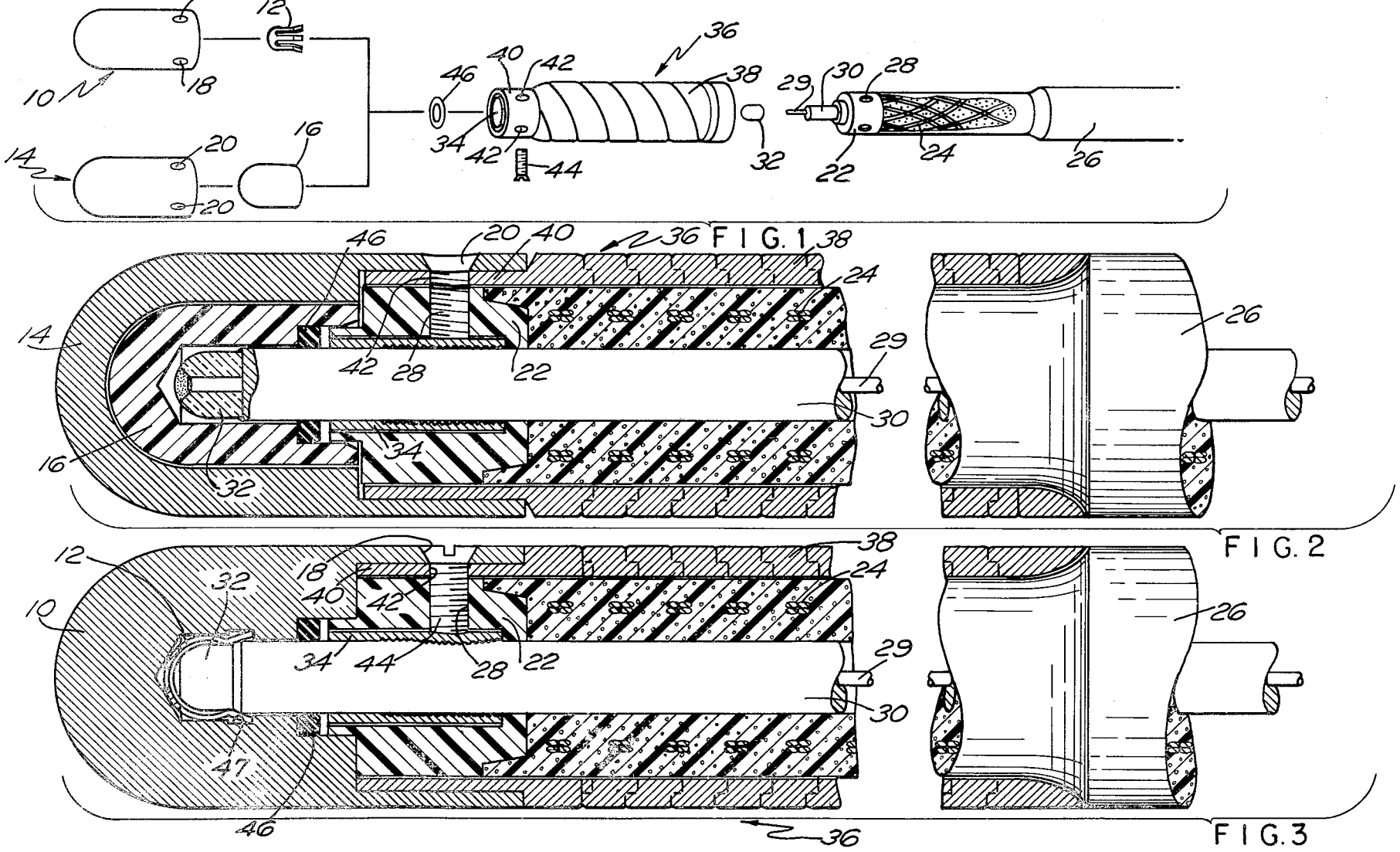
FIG. 1 is an exploded view of the alternate arrangements available, shown partially in section, in accordance with the present invention.
FIG. 2 is a sectional view of the insulating version arrangement of FIG. 1.
FIG. 3 is a sectional view of the grounding version arrangement of FIG. 1.

Referring now to FIG. 1 there is shown an exploded view of both the grounding version and the insulating version of the convertible termination tip. The grounding version configuration includes a metallic nosepiece 10 and metallic spring socket contact 12 that fits within nosepiece 10. The insulating version configuration differs in that it includes an insulating cover 16 that fits within an insulating cover nosepiece 14. The metallic nosepiece 10 has apertures 18 and insulating cover nosepiece 14 has apertures 20.

The remaining portions of the assembly are identical for both the grounding and insulating version configurations. A connector 22 with affixed braided wires 24 is attached to the cable 26 by molding. This arrangement can transfer strength from the cable strength members to connector 22 and in turn to any components attached to connector 22. Connector 22 has apertures 28 whose function will be explained later. Connector 22 and braided wires 24 are the same components as 34 and 14 in U.S. Pat. No. 4,166,921 by the present inventor. Cable 26 has a single conductor 29 with its dielectric covering 30 protruding from connector 22. Conductor 29 terminates in a contact pin 32. A dielectric clamp 34 is located intermediate connector 22 and dielectric wire covering 30.

A flexible sleeve 36 encloses the cable end so as to provide a transition from the metal components to the plastic components. Sleeve 36 comprises a metallic flexible sleeve 38 connected to a metallic cylinder 40. Cylinder 40 has a plurality of apertures 42 that are aligned with and located intermediate apertures 28 and either apertures 18 or 20 depending on the selection of nosepiece 10 or 14. A plurality of screws 44 fit in these apertures aligning the connected components.

An O-ring 46 provides a seal between the dielectric wire covering 30 and the insulating cover 16 in the insulating version configuration and between the dielectric wire covering 30 and the metallic nosepiece 10 in the grounding version configuration. In the insulating configuration the electrical path is terminated at contact pin 32 and the O-ring 46 prevents any seawater from reaching the contact pin 32. In the grounding version configuration the O-ring 46 again prevents any seawater from reaching contact pin 32. However, pin clip 12 makes contact with both pin 32 and metallic nosepiece 10 to provide an electrical conductive path from contact pin 32 to metallic nosepiece 10.

From FIGS. 2 and 3 it can be seen that when either metallic nosepiece 10 or insulating cover nosepiece 14 is positioned onto the other components and attached to connector 22 by screws 44 several functions are accomplished. The screws 44 by attaching the nosepiece 10 or 14 to connector 22, capture the drilled cylinder 40 between the nosepiece 10 or 14 and connector 22. As they are being seated these screws 44 force the dielectric clamp 34 to close on the dielectric wire covering 30 to help prevent fore and aft movement of the wire covering 30 within the termination, due to cable stretch or tensioning. In addition, the fingers of the metallic spring socket contact 12 are prevented from being removed from metallic nosepiece 10 due to cylindrical recess 47.

The design of this tip excludes seawater from the electrical contact 32 so as to eliminate corrosion or oxidation. Thus by interchanging parts the termination tip can be converted any number of times to either grounding or non-grounding configurations. This conversion is easily done taking only a few minutes. The previous models of tips were flooding type of design and thus subject to eventual oxidizing and corrosion. This new design has greater tensile strength transfer capability between the cable and tip components than any previous design. The new features are its watertightness, its ready convertibility, and its increased reliability due to the above, and also greater tensile strength. This new tip is generally considered to be original equipment manufacture, and not field assemblable due to the thermoplastic molding process. Should this tip be damaged through accident or misuse, it can be replaced in the field, with either the MX 9050, MX 4217 or MX 9246, and the repaired cable can be returned to service.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A grounding termination tip configuration comprising:

a buoyant cable having a single conductor with a dielectric covering;

connecting means for connecting to said buoyant cable;

a spring socket contact connected and making electrical contact to the single conductor of said buoyant cable;

an electrical conducting metallic nosepiece connected, making electrical contact and partially enclosing said spring socket contact and connecting to said connecting means; and an O-ring fitted over said dielectric covering of said single conductor and abutting said electrical conducting metallic nosepiece for providing an environmental seal for said single conductor.

2. A grounding termination tip configuration according to claim 1 wherein said connecting means further comprises:

a dielectric clamp for holding said single conductor;

a connector abutting said dielectric clamp;

a flexible sleeve enclosing a segment of said buoyant cable and said connector along their axial lengths; and fasteners connecting said connector, said flexible sleeve and said electrical conducting nosepiece, and for clamping said dielectric clamp to said dielectric covering of said single conductor.

3. An insulating termination tip configuration comprising:

a buoyant cable having a single conductor with a dielectric covering;

connecting means for connecting to said buoyant cable;

an insulating cover fitted over the end of said single conductor and abutting said connecting means;

an insulating cover nosepiece fitted over said insulating cover and connected to said connecting means; and an O-ring fitted over said dielectric covering of said single conductor and abutting said insulating cover for providing an environment seal for said single conductor.

4. A grounding termination tip configuration according to claim 3 wherein said connecting means further comprises:

a dielectric clamp for holding said single conductor;

a connector abutting said dielectric clamp;

a flexible sleeve enclosing a segment of said buoyant cable and said connector along their axial lengths; and fasteners connecting said connector, said flexible sleeve and said insulating cover nosepiece, and for clamping said dielectric clamp to said dielectric covering of said single conductor.

5. A convertible termination tip comprising:

a buoyant cable having a single conductor with a covering of insulated material;

connecting means for connecting to said buoyant cable;

a spring socket contact adapted to connect and make electrical contact to the single conductor of said buoyant cable;

an electrical conducting metallic nosepiece adapted to connect, make electrical contact, and partially enclose said spring socket contact and to connect to said connecting means;

an insulating cover adapted to fit over the end of said single conductor upon removal of said spring socket and said electrical conducting nosepiece from the end of said single conductor, said insulating cover abutting said connecting means;

an insulating cover nosepiece adapted to fit over said insulating cover and to connect to said connecting means; and an O-ring fitted over said covering of insulated material of said single conductor and adapted to abut, one at a time, said electrical conducting metallic nosepiece and said insulating cover, for providing an environmental seal for said single conductor.

6. A ground termination tip configuration according to claim 5 wherein said connecting means further comprises:

a dielectric clamp for holding said single conductor;

a connector abutting said dielectric clamp;

a flexible sleeve enclosing a segment of said buoyant cable and said connector along their axial lengths; and fasteners connecting said connector, said flexible sleeve and one of said electrical conducting metallic nosepiece and said insulating cover nosepiece, and for clamping said dielectric clamp to said dielectric covering of said single conductor.

* * * * *